US006076721A

United States Patent [19]

Yang

[11] Patent Number: 6,076,721

[45] Date of Patent: Jun. 20, 2000

[54] STRUCTURE OF A NAILING MACHINE

[76] Inventor: Hsin-Yu Yang, No. 4, Alley 9, Lane 49, Lo Yang St., San-Chuang City, Taipei, Taiwan

[21] Appl. No.: 09/348,987

[22] Filed: Jul. 7, 1999

[51] Int. Cl.[7] ..... B25C 1/04

[52] U.S. Cl. ..... 227/120; 227/109

[58] Field of Search ..... 227/109, 120, 227/119

[56] References Cited

U.S. PATENT DOCUMENTS

| | | | |
|---|---|---|---|
| 4,801,062 | 1/1989 | Austin | 227/120 |
| 5,615,819 | 4/1997 | Hou et al. | 227/109 |
| 5,632,431 | 5/1997 | Lin | 227/109 |
| 5,743,453 | 4/1998 | Chuang | 227/120 |
| 5,873,509 | 2/1999 | Liao | 227/120 |

*Primary Examiner*—Scott A. Smith
*Attorney, Agent, or Firm*—Pro-Techtor International Services

[57] ABSTRACT

An improved structure of a nailing machine primarily comprises a nailing machine body, a muzzle and a nail chamber. The nail chamber includes a nail chamber body, a nail chamber sliding cover and a lock. The nail chamber sliding cover is installed at one side of the nail chamber body for slidably moving. A plurality of T shape nail supplying guide slots and a back plate supplying guide slot are installed between the nail chamber body and the nailing chamber sliding cover. A lock firmly secures to the upper portion of the rear end of the nail chamber body and has an elastic piece extended backwards and installed with a resisting portion at the rear end thereof for pressing the upper portion of the rear stopper of the distal end of the nail chamber sliding cover so as to be positioned steadily. The nail pushing seat is formed by a nail pushing plate, a sliding guide body and a spring. The sliding guide body and the spring is installed at the C shape guide slot of the nail chamber sliding cover. While the nail pushing plate is retained within the bank nail supplying guide slots. By the elastic force of spring, the nail pushing plate will drive bank nails to move forwards. Thereby, the T shape nail with a rod shape and back plate nail with a thin plate shape can use the same nailing machine. Not only cost is saved, but also the operation of nailing machine is convenient.

1 Claim, 3 Drawing Sheets

STRUCTURE OF A NAILING MACHINE

FIELD OF THE INVENTION

The present invention relates to an improved structure of a nailing machine, and especially to a nailing machine suitable for T shape nails or back plate nails with various specifications.

BACKGROUND OF THE INVENTION

As is known, T shape nails are widely used in the room decoration or wood furniture. While back plate nail with a wedge thin piece often uses in mounting a photography frame or other manual art decoration. These two kinds of nails have different usage. However, in many uses, the two kinds of nails are necessary to be used alternatively. Since these two kinds of nails have completely different functions, no nailing machine may be used for both nails. Thus, workers often feel inconvenient in operation. Moreover, for a D. I. Y. worker, they must buy two nailing machines. Thus, this is not economical.

SUMMARY OF THE INVENTION

Accordingly, the primary object of the present invention is to provide an improved structure of a nailing machine. T shape nail with a rod shape and back plate nail with a thin plate shape can use the same nailing machine without further buying or updating another nailing machine or tools. Not only cost is saved, but also the operation of nailing machine is convenient.

Another object of the present invention is to provide an improved structure of a nailing machine, which has a wider pushing surface for providing a preferred holding force so as to avoid a nail shifts out.

The present invention will be better understood and its numerous objects and advantages will become apparent to those skilled in the art by referencing to the following drawings in which:

DESCRIPTION OF THE PREFERRED EMBODIMENTS

With reference to the appended figures. In the embodiment of the present invention, the front end of the nailing machine body 1 is installed with a muzzle 2. A nail chamber 3 is connected to and communicated with the muzzle 2 so that a bank of nails are supplied to the muzzle continuously for nailing.

Figure 1:
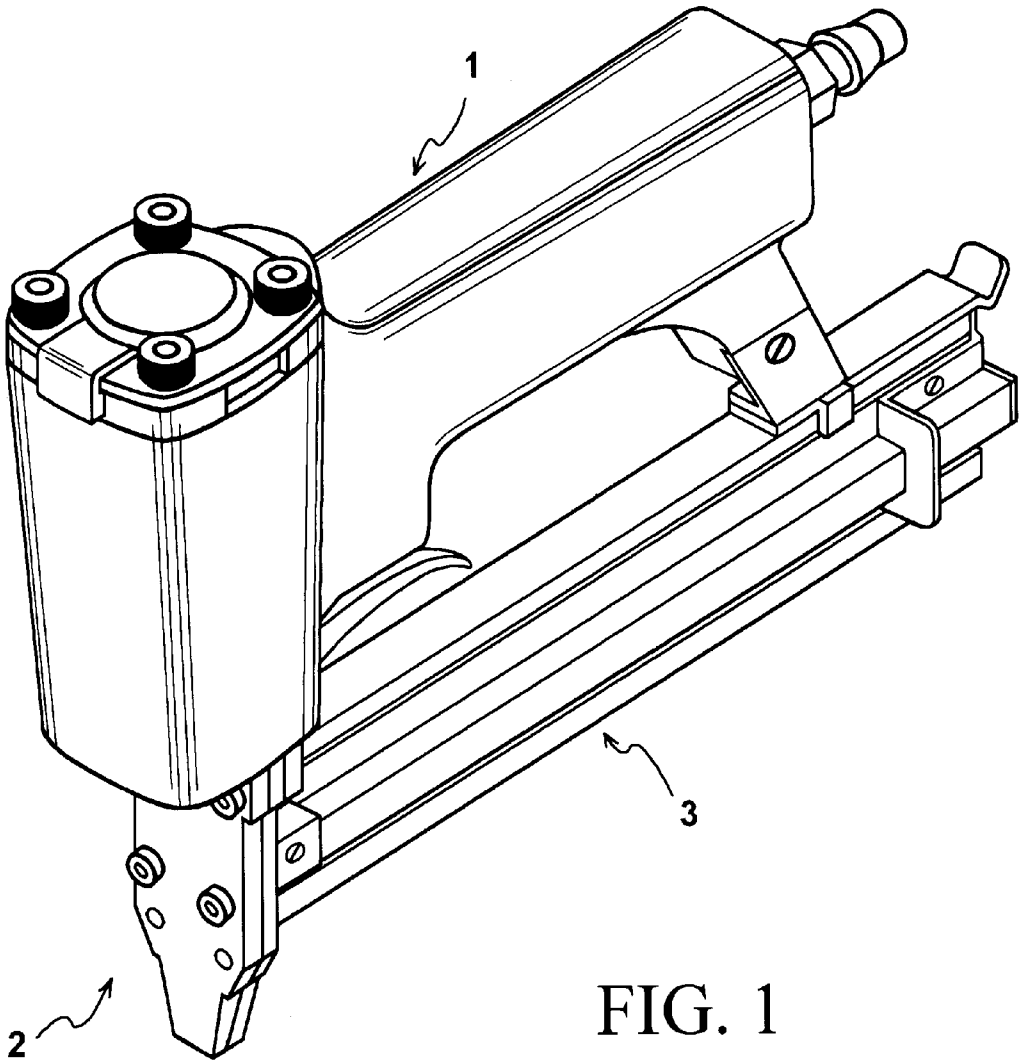
FIG. 1 is an assembled perspective view of the present invention.
Figure 2:
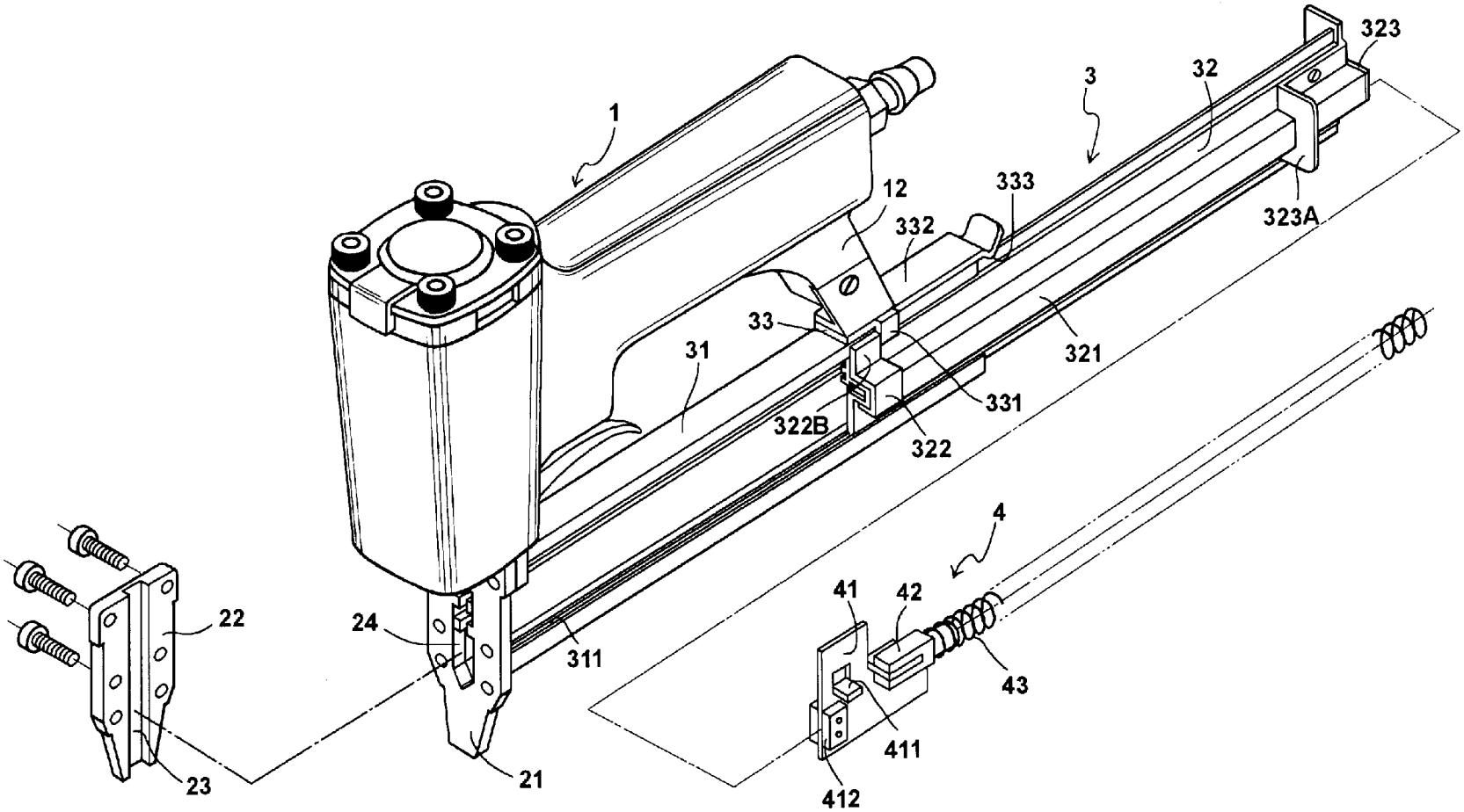
FIG. 2 is an exploded perspective view showing the components of the present invention.
Figure 3:
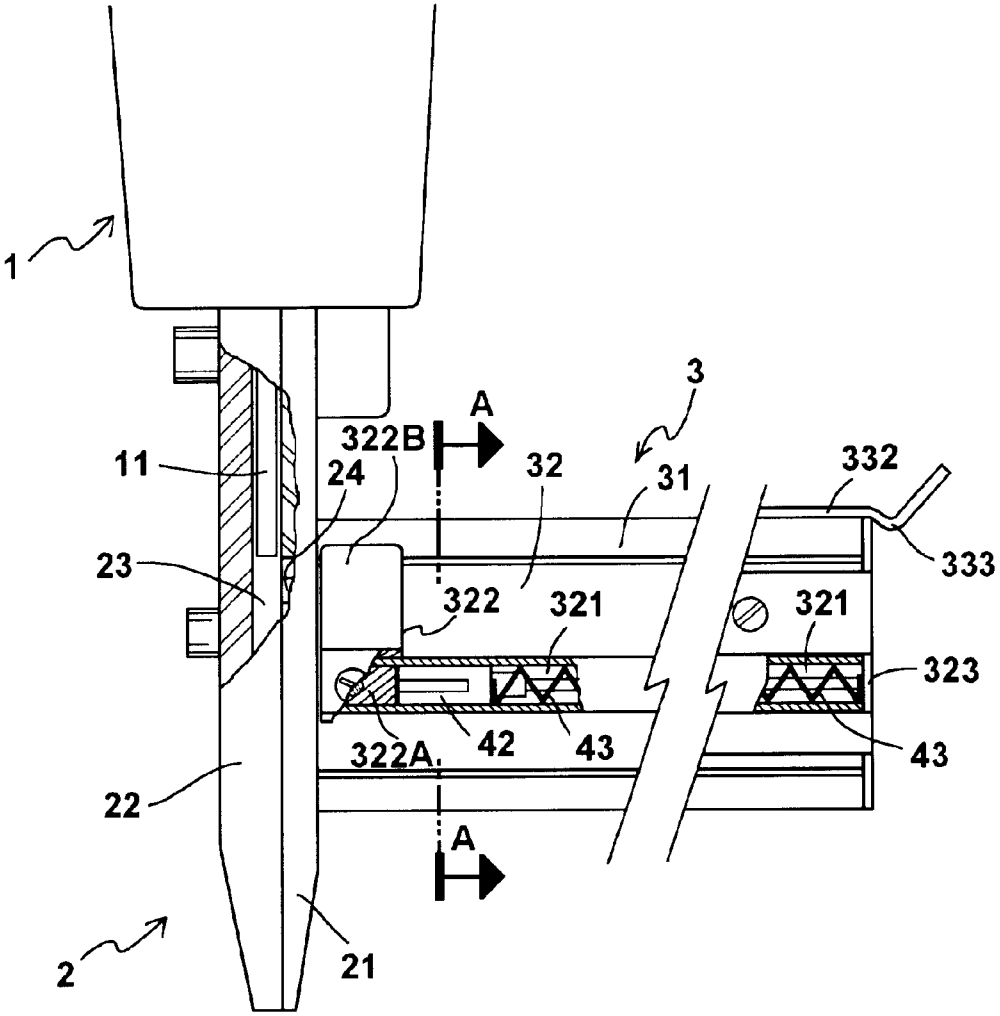
FIG. 3 is the partial lateral cross sectional view of the present invention.

Referring now to FIGS. 2 and 3, the muzzle 2 includes a muzzle base 21 and a muzzle cover 22. After matching the muzzle base 21 and the muzzle cover 22, they are then locked to the front end of the nailing machine body 1. The muzzle cover 22 is installed with a nailing guide slot 23. After assembling, the nailing pin 11 of the nailing machine body is extended so as to be contained within the guide slot 23. Besides a penetrated through hole 24 is installed on the muzzle base 21 and the shape of the through hole 24 is exactly symmetrically to the cross section of the nailing guide slot 23 of the nail chamber 3.

The nail chamber 3 includes a nail chamber body 31 a nail chamber sliding cover 32 and a lock 33. A nail pushing seat 4 is installed in the interior of the nail chamber.

Figure 4:
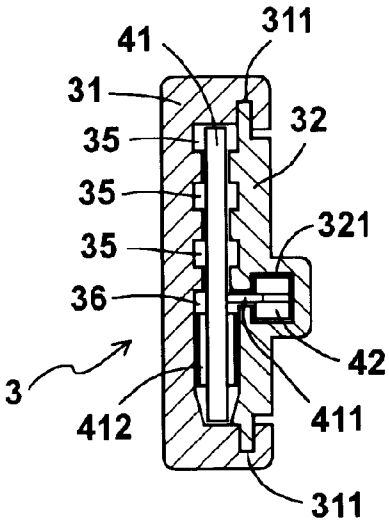
FIG. 4 is a cross sectional view viewing from a line A—A of FIG. 3

The guide trench 311 is installed in the inner rim of the upper and lower edges of the nail chamber body 31. A guide trenches serve to guide the nail chamber sliding cover 32 so that the nail chamber sliding cover 32 may longitudinally move within the trenches. A plurality of grooves are installed at the inner lateral surface of the nailing chamber body 31 with respect to the nailing chamber sliding cover 32 so that a plurality of T shape nail supplying guide slots 35 and a back plate supplying guide slot 36 (as shown in FIG. 4) are installed between the nail chamber body 31 and the nailing chamber sliding cover 32.

A C shape guide slot 321 parallel to the nail bank supplying guide slots 35 and 36 is installed outside the nailing chamber sliding cover 32. The front end of the guide slot 321 is screwedly fixed with a front stopper 322 for closing the rear end of the C shape guide slot. The front stopper 322 has a stopping block 322A extended to the C shape guide slot 321 The front edge of the C shape guide slot 321 is closed. The front stopper 322 has an ear portion 322B protruded outwards and extended upwards. The rear end of the guide slot 321 is screwedly fixed with a rear stopper 323 for closing the rear end of the C shape guide slot 321. The rear stopper 323 has a convex piece 323A extended outwards as a handle for switching the nailing chamber sliding cover 32.

The lock 33 is suitable to be connected to the upper end of the nail chamber 31. One side thereof is installed with an ear portion 331 extended downwards and the rear end thereof is installed with an elastic piece 332 extended rearwards. The distal end of the elastic piece has a bent resisting portion 333.

The nail pushing seat 4 is formed by a nail pushing plate 41, a sliding guide block 42 and a spring 43 so that the width of the nail pushing plate 41 is slightly smaller a portion of bank nail supplying guide slots 35 and 36 with a minimum width. The front end of the nail pushing plate 41 is installed with a guiding piece 41 extended forwards, and two sides of the lower portion of the front edge thereof are connected to respective back plate nail guide block 412 by rivets. The sliding guide block 42 is firmly connected to the lateral surface of the nail pushing plate 41. The rear end of the sliding guide block 42 is combined with a long spring 43.

With reference to FIG. 2, in the aforementioned nail chamber body 31, the front end thereof is screwedly fixed to the rear surface of the muzzle base 21 and by the distal end of the nail chamber body 31 being connected to the lock 33, an extending arm 12 screwedly fixed to the lower portion of the nailing machine body. The assembled bank nail supplying guide slots 35 and 36 are exactly aligned to the through hole 24 of the muzzle base. Therefore, bank nails may successfully pass through the through hole 24 to the nailing guide slot 23 from the bank nail supplying guide slots 35 and 36 for being used.

In assembling, the sliding guide block 42 and a spring 43 are placed into the C shape guide slot 321 of the nail chamber sliding cover, however, the front end and rear end further are confined by the stopping block 322A and the rear stopper 323. While the nail pushing plate 41 is retained in the bank nail supplying guide slots 35 and 36. By the elastic force of the spring 43, the nail pushing plate 41 will drive the bank nails to move forwards. Besides, the nail chamber sliding cover 32 is in the guide trench 311. When positioning, the upper end of the rear stopper 323 at the distal end of the nail chamber sliding cover is pressed by the resisting portion 333 of the elastic piece so as to be steadily closed and positioned in order to avoid that the nail chamber sliding cover 32 is released by accident as the nailing machine is operated. When the cover is opened for supplying bank nails, the rear stopper 323 of the nail chamber sliding cover separates from the pressing of the resisting portion 333 of the elastic piece. By matching the ear portion 322B of the front stopper on the nail chamber sliding cover with the ear portion 331 of the lock for confining the opening position of the nailing machine body cover 32 in order that as the nail chamber sliding cover 32 is released from the guide trench 311 of the nail chamber body.

In summary, the nail chamber 3 of the present invention has a plurality of T shape nail supplying guide slots 35 and back plate nail supplying guide slot 36. Thus, the T shape nail with a rod shape and back plate nail with a thin plate shape can use the same nailing machine. Not only cost is saved, but also the operation of the present invention is convenient. The two sides of the lower portion at the front edge of the nail pushing plate 41 are connected to respective back plate nail guide block 412, thus a wider guiding surface is formed in order to provide a preferred holding force as the bank nails are pushed forwards. Thus, the nail is avoided to shift out of the slot.

Although the present invention has been described using specified embodiment, the examples are meant to be illustrative and not restrictive. It is clear that many other variations would be possible without departing from the basic approach, demonstrated in the present invention.

What is claimed is:

1. An improved structure of a nailing machine primarily comprising a nailing machine body, a muzzle and a nail chamber wherein the front end of the nailing machine body is installed with the muzzle, the nail chamber is connected to and communicated with the muzzle so that a bank of nails are supplied to the muzzle continuously for nailing; characterized in that:

the nail chamber includes a nail chamber body, a nail chamber sliding cover and a lock, a nail pushing seat is installed in an interior of the nail chamber; a guide trench is installed in each inner side of the upper and lower edges of the nail chamber body, the guide trenches serve to guide the nail chamber sliding cover so that the nail chamber sliding cover longitudinally moved within the trenches, a plurality of grooves are installed at an inner lateral surface of the nailing chamber body with respect to the nailing chamber sliding cover so that a plurality of T shape nail supplying guide slots and a back plate supplying guide slot are installed between the nail chamber body and the nailing chamber sliding cover; a C shape guide slot parallel to the nail bank supplying guide slots and is installed outside the nailing chamber sliding cover; a front stopper is screwedly fixed to a front end of the C shape guide slot so as to seal the front edge of the C shape guide slot, a rear end of the C shape guide slot is screwedly fixed with a rear stopper for closing the rear end of the C shape guide slot; the lock is connected to an upper end of the rear end of the nail chamber, an elastic piece extended backwards is installed at the lock, a distal end of the elastic piece has a bent resisting portion for being pressed at an upper end of the rear stopper at a distal end of the nailing chamber sliding cover so as to be positioned steadily; the nail pushing seat is formed by a nail pushing plate, a sliding guide block and a spring so that a width of the nail pushing plate is slightly smaller than a portion of bank nail supplying guide slots with a minimum width;

a front end of the nail pushing plate is installed with a guiding piece extended forwards, and two sides of a lower portion of the front edge thereof are connected to respective back plate nail guide block by rivets, the sliding guide block is firmly connected to a lateral surface of the nail pushing plate, a rear end of the sliding guide block is combined with said spring; wherein during assembly, the sliding guide block and the spring are placed into the C shape guide slot of the nail chamber sliding cover, the front end and rear end are confined by the stopping block and the rear stopper; while the nail pushing plate is retained in the bank nail supplying guide slots, by the elastic force of the spring the nail pushing plate will drive the bank nails to move forwards.

* * * * *